United States Patent [19]

Reynolds

[11] 4,395,782

[45] Aug. 2, 1983

[54] BELT SYSTEM FOR SURGICAL GOWN

[75] Inventor: Elizabeth B. Reynolds, Bartlett, Tenn.

[73] Assignee: The Buckeye Cellulose Corporation, Cincinnati, Ohio

[21] Appl. No.: 316,628

[22] Filed: Oct. 30, 1981

[51] Int. Cl.[3] ..... A41B 13/10

[52] U.S. Cl. ..... 2/114; 2/DIG. 7

[58] Field of Search ..... 2/114, DIG. 7, 51

[56] References Cited

U.S. PATENT DOCUMENTS

| | | | |
|---|---|---|---|
| 3,359,569 | 12/1967 | Rotanz et al. | 2/114 |
| 3,594,818 | 7/1971 | Planner | 2/114 |
| 3,648,290 | 3/1972 | Hartigan | 2/114 |
| 3,696,443 | 10/1972 | Taylor | 2/114 |
| 3,721,999 | 3/1973 | Goya et al. | 2/114 |
| 3,935,596 | 2/1976 | Allen, Jr. et al. | 2/114 |
| 3,977,025 | 8/1976 | Horan | 2/114 |
| 3,988,781 | 11/1976 | Horan | 2/338 |
| 4,016,604 | 4/1977 | Welke | 2/51 |
| 4,019,207 | 4/1977 | Newman et al. | 2/51 |
| 4,075,716 | 2/1978 | Collins | 2/114 |
| 4,326,300 | 4/1982 | Bolton et al. | 2/114 |

*Primary Examiner*—Doris L. Troutman

*Attorney, Agent, or Firm*—Milton B. Graff, IV; John V. Gorman; Richard C. Witte

[57] ABSTRACT

A two piece belt system for use on a back closure surgical gown has a lefthand belt section with one end fixed to the gown front at about waist level. The lefthand belt section is removably retained in a tunnel-like pouch attached to the front of the gown. The righthand belt section is attached to the outer edge of the right rear flap of the gown at about waist level; its free end is releasably attached to a card-like transfer device. The transfer device is removably retained in the pouch.

6 Claims, 6 Drawing Figures

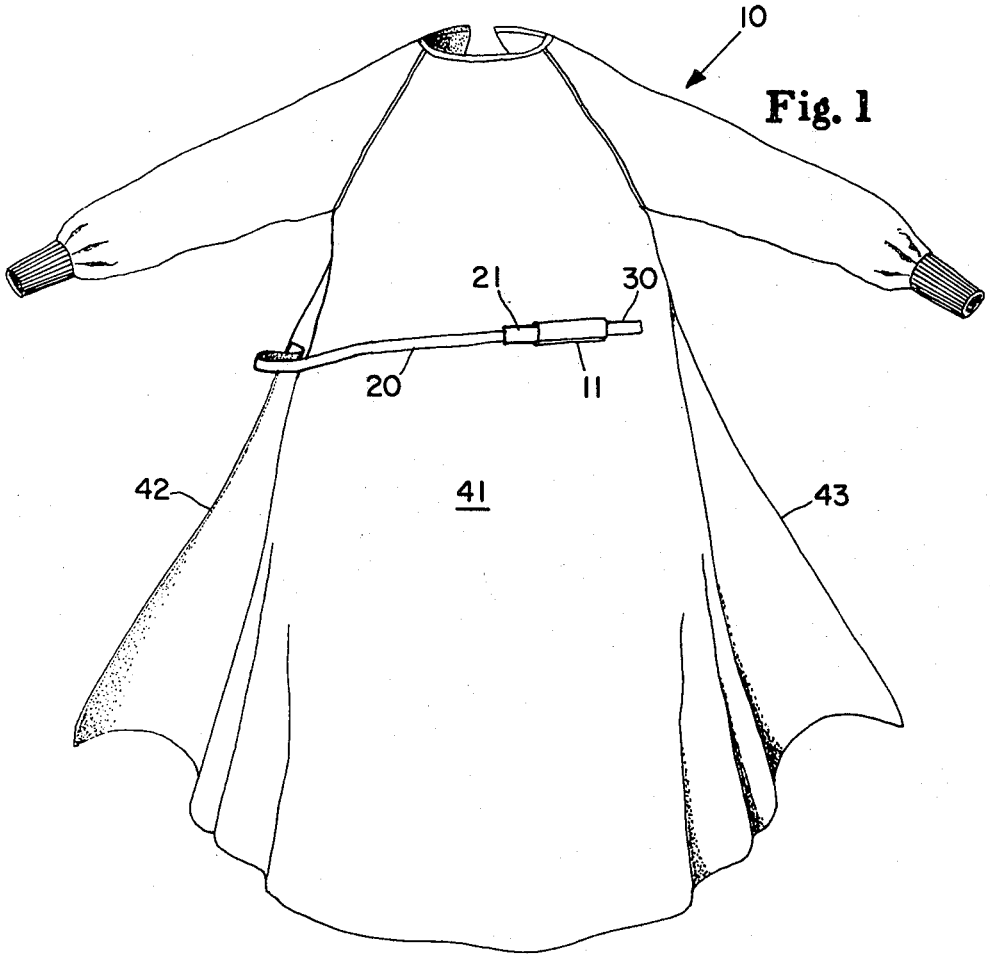
Fig. 1
Fig. 2
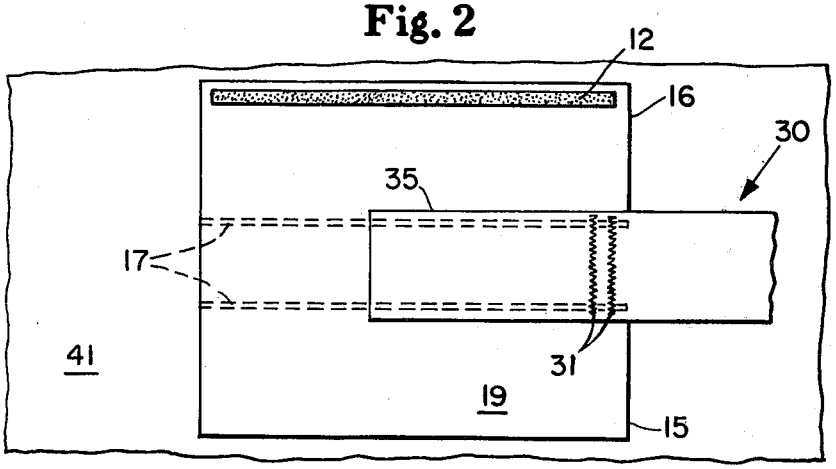

BELT SYSTEM FOR SURGICAL GOWN

TECHNICAL FIELD

This invention relates to a gown for use in surgical operations and, more specifically, to a belt system for such gown.

BACKGROUND ART

A primary consideration in the design of belt systems for surgical gowns is the ease and convenience of securing the gown in place on the wearer while maintaining sterility of the critical areas of the gown, in particular, the gown front and sleeves. Most surgical gowns have their openings in the back. To don such a gown, the gown is held open and the wearer, facing the solid front portion of the gown, inserts his arms into the sleeves. Rear flaps are overlapped on the wearer's back and are secured in place by a belt system. With back opening gowns, proper sterile technique prohibits a sterile person from reaching behind his back or from touching the rear flaps of the gown or anywhere below the gown's waist. (These areas are considered non-sterile areas.)

Belt systems where one belt totally surrounds the wearer and is tied at about waist level are well known. Examples of such a belt system are disclosed in U.S. Pat. No. 3,359,569 issued Dec. 26, 1967, to Rotanz et al.; U.S. Pat. No. 3,594,818 issued July 27, 1971, to Planner; U.S. Pat. No. 3,648,290 issued Mar. 14, 1972, to Hartigan; U.S. Pat. No. 3,721,999 issued Mar. 27, 1973, to Goya et al.; U.S. Pat. No. 4,075,716 issued Feb. 28, 1978, to Collins; and assignee's copending application Ser. No. 45,157, filed June 4, 1979, by Bolton et al. One-piece belt systems generally require the assistance of a non-sterile person to wrap the belt around the wearer. A sterile person cannot assist if, as is generally so, one end of the belt is attached to the back flap of the gown, a non-sterile area. For this same reason the wearer cannot self-belt.

Another type of belt closure known in the art is a two piece belt system in which the two belt sections each have one fixed end and one free end. Generally, the lefthand belt section has one end attached to the gown at about waist level at the left front of the gown. The righthand belt section has one end attached near the outer edge of the right rear flap of the gown at about waist level. When the gown is worn, the right rear flap overlaps the left rear flap behind the wearer. The two belt sections are then tied together on the left side of the wearer to secure the gown in place. Examples of this type of belt system are disclosed in U.S. Pat. No. 3,935,596 issued Feb. 3, 1976, to Allen et al.; U.S. Pat. No. 3,977,025 issued Aug. 31, 1976, to R. Horan; U.S. Pat. No. 3,988,781 issued Nov. 2, 1976, to P. Horan; U.S. Pat. No. 4,016,604 issued Apr. 12, 1977, to Welke; and U.S. Pat. No. 4,019,207 issued Apr. 26, 1977, to Newman et al.

Two-piece belt systems offer an advantage over one-piece belt systems, in that assistance is not limited to non-sterile personnel. Both belt sections are often accessable to the wearer on the front of the gown. A transfer device is usually releasably attached to the free end of the righthand belt section which will be wrapped around the wearer. The wearer can hand the transfer device to either sterile or non-sterile personnel for belting assistance, since the assistant need touch only the transfer device. The assistant walks the transfer device with the righthand belt section attached around the back of the wearer (or the wearer turns to his left) thus causing the right rear flap of the gown to close over the left rear flap. Alternatively, the wearer can self-belt by placing the transfer device on a sterile surface, place a sterile weight on the transfer device, and turn to his left to close the back of the gown. The wearer grasps the righthand belt section, pulls it from the transfer device, and ties the two belt sections together. The transfer device is discarded.

In Allen, both free ends of the two belt sections are held at the front of the gown by a transfer device; the free ends are held separately in two openings of the device. The wearer pulls the left-hand belt section end from the transfer device and hands the transfer device with the righthand belt section attached to the assistant. Because the transfer device is not secured to the body of the gown in Allen, the transfer device and the attached belt sections can swing away from the gown body and thus have a greater chance of contacting a non-sterile object and being thereby contaminated during the unfolding and donning procedures.

R. Horan, P. Horan, Welke and Newman all show the lefthand belt section held by a "tunnel loop" attached to the left front of the gown. This belt section is folded once and the fold is inserted through the tunnel loop so that the fold projects from one end of the tunnel loop and the free end of the belt from the other end of the tunnel loop.

Newman uses a transfer device on the free end of the righthand belt section. The righthand belt section is held in front of the gown by having a loop of the belt section inserted through a tunnel loop on the right front of the gown. Newman thus lacks the convenience of having the two free ends of the belt sections held in close proximity on the front of the gown.

In R. Horan, P. Horan, and Welke the right-hand belt section is folded in a pocket attached to the right rear flap of the gown. In R. Horan and P. Horan, a transfer device is attached to the free end of this belt section and is contained partially in the pocket; in Welke, the pocket is detachable and becomes the transfer device. However, since the righthand belt section is attached to a rear flap of the gown which is a non-sterile area, it would be a violation of sterile technique for a sterile person to assist the wearer with belting of these gowns or for the wearer to self-belt.

It is an object of the present invention to provide a novel two-piece belt system for surgical gowns.

It is also an object of this invention to provide such a belt system that will help insure that the required sterile areas of the gown exterior are not inadvertently contaminated.

It is a further object of this invention to provide such a belt system that is convenient to secure in place with the aid of either a sterile or non-sterile assistant, or to self-belt.

DISCLOSURE OF THE INVENTION

The present invention concerns a two piece belt system for a surgical gown. Both free ends of the belt sections are removably retained in a tunnel-like pouch located on the front of the gown at about waist level. The free end of the righthand belt section is releasably attached to a transfer device which is removably retained in the pouch.

BRIEF DESCRIPTION OF THE DRAWINGS

FIG. 1 is a front view of a surgical gown with the belt system of the present invention in place prior to use.

FIG. 2 is an enlarged fragmentary front view of the surgical gown of FIG. 1 during assembly, showing the partially constructed pouch and the fixed end of the lefthand belt section.

DETAILED DESCRIPTION OF THE INVENTION

Figure 3:
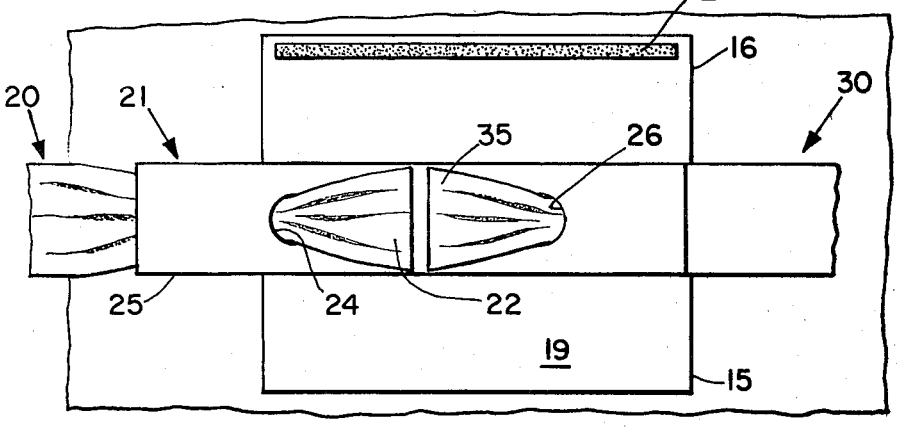
FIG. 3 is an enlarged fragmentary front view similar to FIG. 2 with the transfer device holding the free end of the righthand belt section in place.

Referring to the drawings wherein like reference characters are utilized to identify like parts throughout the several views, there is illustrated in FIG. 1 a surgical gown 10. The gown is preferably constructed of a nonwoven fabric such as that described in U.S. Pat. No. 4,113,911 issued on Sept. 12, 1978, to LaFitte et al., the disclosure of which is hereby incorporated by reference.

Gown 10 is comprised of a front 41, right rear flap 42, and left rear flap 43. On the front 41 of gown 10 at about waist level, preferably on the left front, there is a tunnel-like pouch 11 attached to gown 10. Gown 10 has a two-piece belt system, each belt section having a fixed end and a free end. Lefthand belt section 30 has its fixed end attached to the front 41 of gown 10, preferably at the same point as pouch 11. Pouch 11 removably retains folded lefthand belt section 30, and a transfer device 21 which holds the free end of righthand belt section 20. The fixed end of righthand belt section 20 is attached to the outer edge of right rear flap 42 at about waist level.

A preferred assembly of the belt system is shown in FIGS. 2-6. The components of the belting system can be made of any flexible, strong material such as a woven or nonwoven fabric. Except where specified otherwise, the preferred material for the components is the same as the material used for the gown.

In FIG. 2, the incompleted pouch is shown to begin as a rectangular pouch piece 19 of fabric. Lefthand belt section 30 is an elongate rectangular piece of fabric. The fixed end of lefthand belt section 30 and pouch piece 19 are attached to gown front 41 by any conventional attaching means. Preferably, pouch piece 19 is attached to gown front 41 by light adhesive strips 17 which extend over a substantial portion of the width of pouch piece 19. Sewn stitches 31 are then preferably used to attach lefthand belt section 30 to pouch piece 19 and gown front 41. Stitches 31 are preferably located toward the right side of pouch piece 19 as viewed in FIG. 2 such that the fixed end of lefthand belt section 30 has a free tab 35 immediately adjacent the point of attachment.

As shown in FIG. 3, righthand belt section 20 has a free end 22 that is releasably attached to a transfer device 21. Preferably free end 22 is inserted through an opening 24 in transfer device 21. Transfer device 21 is preferably made of a stiff, flexible material such as thin cardboard. Transfer device 21 can be removably retained in pouch 11 in any of a number of ways. A preferred method is to provide the transfer device 21 with a second opening 26 through which free tab 35 of lefthand belt section 30 is inserted, thus positioning transfer device 21 atop pouch piece 19 and the secured end of lefthand belt section 30. The end 25 of transfer device 21 toward righthand belt section 20 extends to the left of pouch piece 19, as viewed from the front. Lefthand belt section 30 is then folded atop transfer device 21 by any conventional means, preferably by fan folding, such that free end 32 of lefthand belt section 30 extends to the right of pouch piece 19 as shown in FIG. 4.

Figure 4:
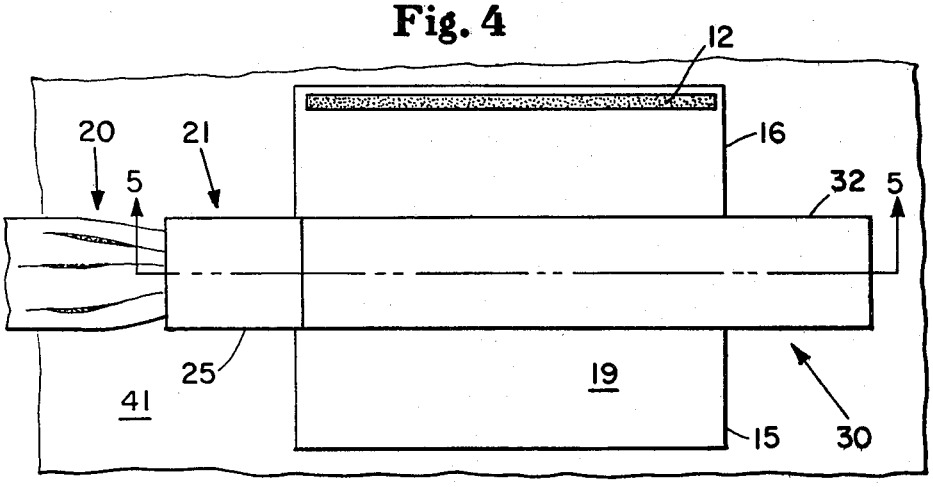
FIG. 4 is an enlarged fragmentary front view similar to FIG. 3 with the lefthand belt section folded in place.
Figure 5:
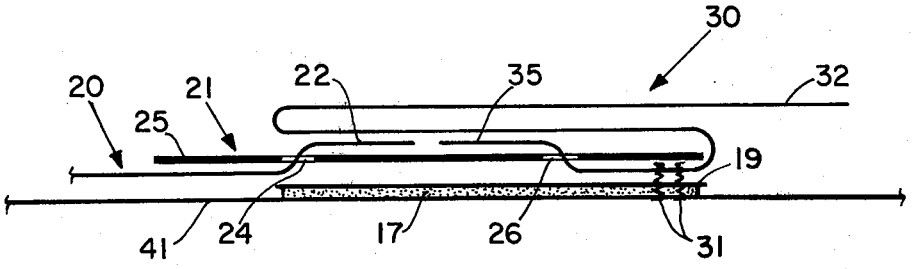
FIG. 5 is a schematic sectional view of the partially constructed pouch, belt section and transfer device, taken along line 5—5 of FIG. 4.

FIG. 5 shows a schematic sectional view of the belt system components taken along line 5—5 of FIG. 4. Pouch piece 19 is attached to gown front 41 by adhesive 17, and lefthand belt section 30 is attached to both pouch piece 19 and gown front 41 by stitches 31. Transfer device 21 with free end 22 of righthand belt section 20 and free tab 35 of lefthand belt section 30 extending therethrough is shown positioned atop the attached portion of lefthand belt section 30 and pouch piece 19 with transfer device end 25 extending to the left of pouch piece 19. Lefthand belt section 30 is shown fan folded atop transfer device 21 with its free end 32 extending to the right of pouch piece 19.

Tunnel-like pouch 11 is completed by folding side flaps 15 and 16 of pouch piece 19 over transfer device 21 and folded lefthand belt section 30. A preferred method of completing pouch 11 is to first fold side flap 15 atop folded lefthand belt section 30 and then fold side flap 16 with applied adhesive strip 12 over side flap 15 so that adhesive strip 12 adheres the side flaps 15 and 16 together. The completed assembly is shown in FIG. 6.

Figure 6:
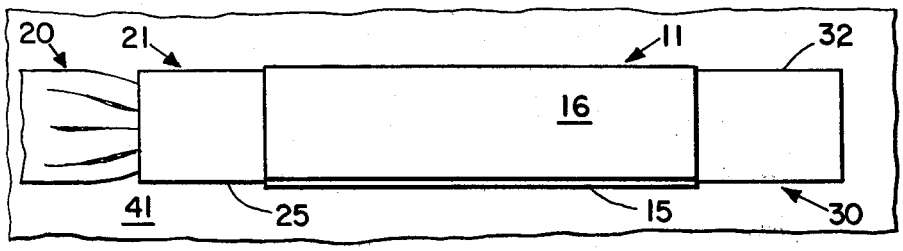
FIG. 6 is an enlarged fragmentary front view of the surgical gown of FIG. 1, showing the completed pouch holding the folded lefthand belt section and the transfer device to which the right-hand belt section is attached.

The completed belt assembly as shown in FIG. 6 is used in the following manner. End 25 of transfer device 21 which projects from pouch 11 is grasped by the wearer and transfer device 21 is pulled from pouch 11. In pulling transfer device 21 from pouch 11, free tab 35 of lefthand belt section 30 slips out of opening 26 of transfer device 21. The wearer then hands transfer device 21 to an assistant or places it under a weight on a table if self-belting. The assistant walks with transfer device 26 and attached righthand belt section 20 around the back of the wearer, or the wearer turns to his left, to close the back of the gown and bring righthand belt section 20 to the wearer's left side. The wearer grasps free end 32 of lefthand belt section 30 which projects from pouch 11 and pulls lefthand belt section 30 from pouch 11. The wearer then graps righthand belt section 20 and pulls righthand belt section 20 from transfer device 21. The wearer then ties the two belt sections together on his left side at about waist level.

An alternative configuration of pouch 11 contents is achieved by laying transfer device 21 atop folded lefthand belt section 30 (free tab 35 is thereby not secured through opening 26). This configuration is not preferred due to the tendency of transfer device 21 to fall out of pouch 11 prematurely. This problem can be reduced by making transfer device 21 longer so that it extends out both ends of pouch 11, and by making transfer device 21 slightly wider and indenting its sides so that it fits more securely in pouch 11. Other methods of removably retaining transfer device 21 in pouch 11 will be obvious to one skilled in the art.

While particular embodiments of the present invention have been illustrated and described, those skilled in the art will recognize that various changes and modifications can be made without departing from the spirit and scope of the invention. It is intended to cover, in the appended claims, all such modifications that are within the scope of this invention.

What is claimed is:

1. A belt system for use on a back closure surgical gown, said gown having a front, a right rear flap and a left rear flap, said system comprising:

(a) a lefthand belt section having a fixed end attached to said front of said gown at about waist level, and a free end;

(b) a tunnel-like pouch attached to said front of said gown, said lefthand belt section being removably retained in said pouch;

(c) a righthand belt section having a fixed end attached near the outer edge of said right rear flap at about waist level, and a free end; and (d) a transfer device releasably attached to said righthand belt section free end, said transfer device being removably retained in said pouch.

2. The belt system of claim 1 wherein said lefthand belt section is fan folded in said pouch.

3. The belt system of claim 1 or 2 wherein said lefthand belt section fixed end is attached within said pouch.

4. The belt system of claim 3 wherein said lefthand belt section fixed end has a free tab immediately adjacent the point of attachment of said fixed end and said free tab is releasably attached to said transfer device.

5. The belt system of claim 2 wherein said transfer device overlies said folded lefthand belt section.

6. The belt system of claim 5 wherein said transfer device is generally of rectangular shape with indented sides.

* * * * *